US009840758B2

(12) United States Patent
Lee et al.

(10) Patent No.: US 9,840,758 B2
(45) Date of Patent: Dec. 12, 2017

(54) LEADLESS FREE-CUTTING COPPER ALLOY AND METHOD FOR PRODUCING THE SAME

(75) Inventors: Beum Jae Lee, Ulsan (KR); Won Hone Kim, Ulsan (KR); Cheol Min Park, Daejeon (KR); Young Re Cho, Ulsan (KR); Min Jae Jeong, Ulsan (KR)

(73) Assignee: POONGSAN CORPORATION, Pyeongtaek-si (KR)

( * ) Notice: Subject to any disclaimer, the term of this patent is extended or adjusted under 35 U.S.C. 154(b) by 895 days.

(21) Appl. No.: 14/347,214

(22) PCT Filed: Jul. 31, 2012

(86) PCT No.: PCT/KR2012/006082
§ 371 (c)(1),
(2), (4) Date: Mar. 25, 2014

(87) PCT Pub. No.: WO2013/047991
PCT Pub. Date: Apr. 4, 2013

(65) Prior Publication Data

US 2014/0248175 A1 Sep. 4, 2014

(30) Foreign Application Priority Data

Sep. 30, 2011 (KR) ..... 10-2011-0099741

(51) Int. Cl.
*C22C 9/04* (2006.01)
*C22F 1/08* (2006.01)
(Continued)

(52) U.S. Cl.
CPC ..... *C22C 9/04* (2013.01); *B21B 1/026* (2013.01); *B21C 23/002* (2013.01); *C22F 1/08* (2013.01)

(58) Field of Classification Search
CPC ..... B21B 1/026; B21C 23/002; C22C 9/04; C22F 1/08
See application file for complete search history.

(56) References Cited

U.S. PATENT DOCUMENTS 6,413,330 B1 7/2002 Oishi
7,909,946 B2 3/2011 Oishi
(Continued)

FOREIGN PATENT DOCUMENTS

CN 101068941 A 11/2007
EP 1 600 515 A2 11/2005
(Continued)

OTHER PUBLICATIONS

Chinese Office Action dated May 6, 2015 as received in Application No. 201280047395.X (English Translation).
(Continued)

*Primary Examiner* — Kaj K Olsen
*Assistant Examiner* — Alexander Polyansky
(74) *Attorney, Agent, or Firm* — Maschoff Brennan

(57) ABSTRACT

Disclosed is a leadless free-cutting copper alloy that exhibits superior machinability, cold workability and dezincification resistance and a method for producing the same. The leadless free-cutting copper alloy comprises 56 to 77% by weight of copper (Cu), 0.1 to 3.0% by weight of manganese (Mn), 1.5 to 3.5% by weight of silicon (Si), and the balance of zinc (Zn) and other inevitable impurities, thus exhibiting superior eco-friendliness, machinability, cold workability and dezincification resistance.

11 Claims, 3 Drawing Sheets

A : Ranges of the alloy components of the related art
B : Ranges of the alloy components of the present invention

(51) Int. Cl.
*B21B 1/02* (2006.01)
*B21C 23/00* (2006.01)

(56) References Cited

U.S. PATENT DOCUMENTS

| | | | | |
|---|---|---|---|---|
| 8,435,361 | B2 | 5/2013 | Gaag et al. | |
| 2004/0140022 | A1 | 7/2004 | Inohana et al. | |
| 2004/0234411 | A1* | 11/2004 | Hofmann | C22C 9/04 420/473 |
| 2006/0078458 | A1* | 4/2006 | Strobl | C22C 9/04 420/477 |
| 2008/0202653 | A1 | 8/2008 | Ignberg | |
| 2010/0297464 | A1 | 11/2010 | Oishi | |
| 2011/0211781 | A1 | 9/2011 | Toda et al. | |
| 2012/0027638 | A1 | 2/2012 | Kosaka et al. | |

FOREIGN PATENT DOCUMENTS

| | | | | |
|---|---|---|---|---|
| JP | 62-274036 | A | | 11/1987 |
| JP | 62-278242 | A | | 12/1987 |
| JP | 63-130738 | A | | 6/1988 |
| JP | 09111376 | A | * | 4/1997 |
| JP | 2000-119775 | A | | 4/2000 |
| JP | 2000-273596 | A | | 10/2000 |
| JP | 2002-155326 | A | | 5/2002 |
| JP | 2003-253359 | A | | 9/2003 |
| JP | 3734372 | B2 | | 1/2006 |
| JP | 2008-001964 | A | | 1/2008 |
| JP | 2008-529803 | A | | 8/2008 |
| KR | 10-2008-0071276 | A | | 8/2008 |
| KR | 10-2008-0071277 | A | | 8/2008 |
| KR | 10-2010-0114596 | A | | 10/2010 |
| KR | 10-1045080 | B1 | | 6/2011 |
| WO | 2006/016442 | A | | 2/2006 |
| WO | 2006/016624 | A1 | | 2/2006 |
| WO | 2010/122960 | A1 | | 10/2010 |

OTHER PUBLICATIONS

European Search Report dated Oct. 6, 2015 as received in Application No. 12835655.7.

* cited by examiner

【Fig. 1】
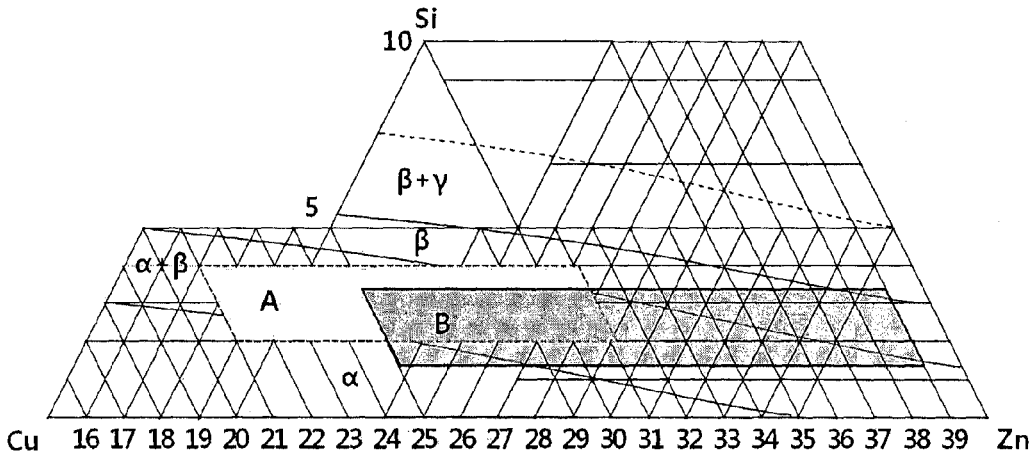
A : Ranges of the alloy components of the related art
B : Ranges of the alloy components of the present invention
【Fig. 2】
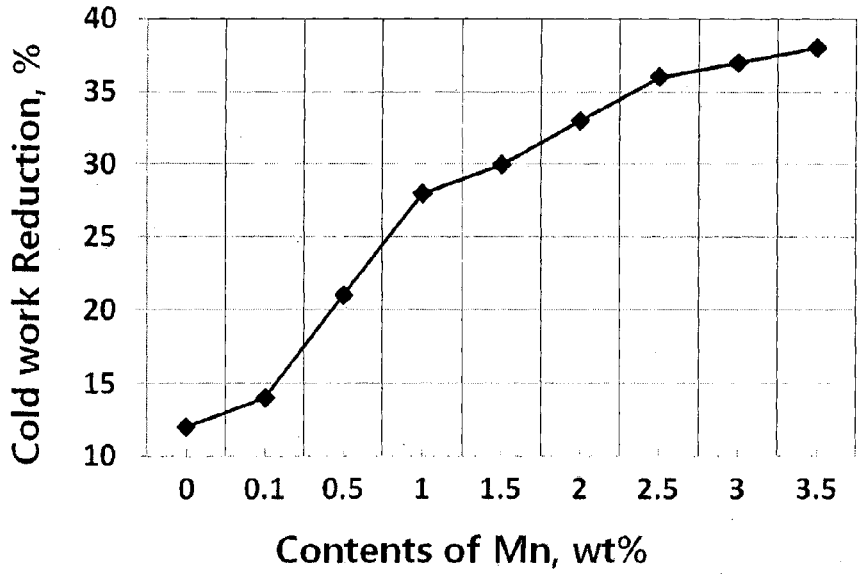

【Fig. 3】
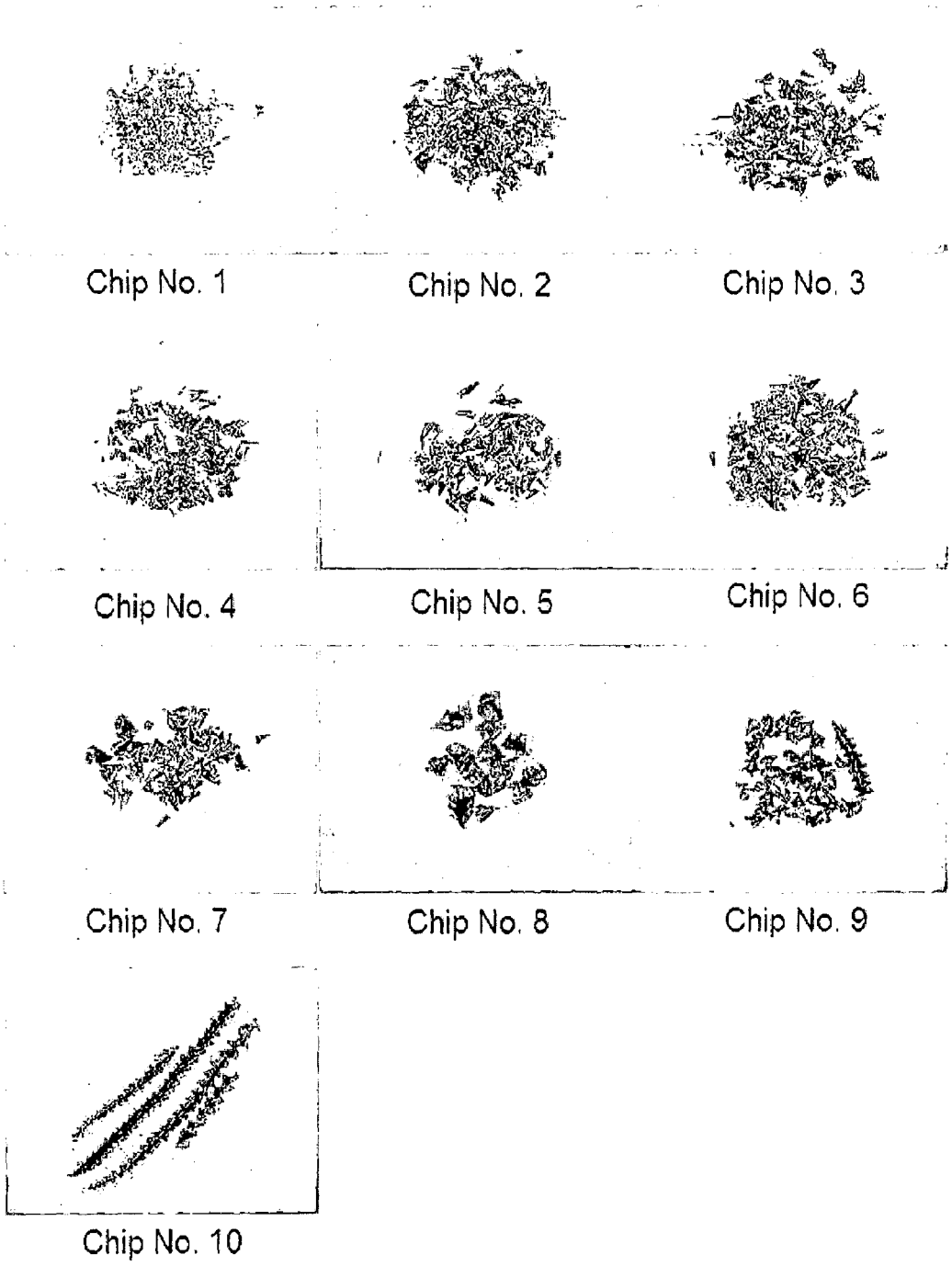

【Fig. 4】
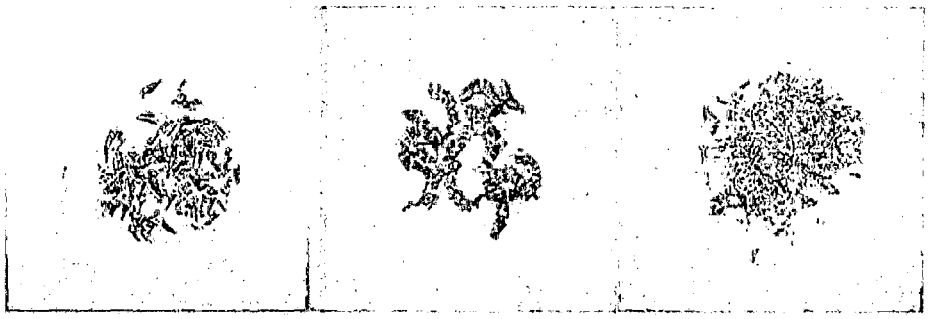
Examples 1-5 (high-speed cutting) | Example 1-5 (low-speed cutting) | Example 2-3 (low-speed cutting)

LEADLESS FREE-CUTTING COPPER ALLOY AND METHOD FOR PRODUCING THE SAME

TECHNICAL FIELD

The present invention relates to a leadless free-cutting copper alloy that exhibits superior machinability, cold workability and dezincification resistance and a method for producing the same. More specifically, the present invention relates to a leadless free-cutting copper alloy comprising 56 to 77% by weight of copper (Cu), 0.1 to 3.0% by weight of manganese (Mn), 1.5 to 3.5% by weight of silicon (Si), and the balance of zinc (Zn) and other inevitable impurities, and a method for producing the same.

BACKGROUND ART

Copper (Cu) is a representative nonferrous metal which exhibits superior alloy properties, and copper materials to which a variety of ingredients are added according to the intended purpose are widely used in various fields. Copper and copper alloy materials are roughly classified into plate materials, rods, tubular materials and castings. Such a material is used for a variety of products or materials via the post process. For example, phosphorous bronze, that is produced by adding less than 1% by weight of phosphorous (P) in order to reinforce hardness and strength of copper alloys and to improve corrosion resistance, is used for processed materials such as plates and cables requiring high elasticity, and is used for castings of pump components, gears, ship components, chemical mechanical components and the like. Also, aluminum bronze in which a small amount of aluminum (Al) is added to copper (Cu) was not utilized in general applications due to problems such as melt-casting or self-annealing and the application thereof gradually extends in accordance with metallographic requirements and melt-casting techniques' improvement. Strength brass, called "Manganese (Mn) bronze" is obtained by alloying brass with 1 to 3% by weight of manganese, and can satisfy requirements such as strength, corrosion resistance and seawater resistance when elements such as aluminum (Al), iron (Fe), nickel (Ni), tin (Sn) and so on are added thereto.

In addition, copper (Cu) has a high elongation to the extent that it can be processed into thin plates or fine cables. As an elongation increases, the parent metal is stuck on a tool during a cutting process, a great amount of heat is generated, and cutting processability is deteriorated, for example, the processed surface is roughened and lifespan of the tool is shortened. An alloy that solves these problems and exhibits improved cutting processability is referred to as a free-cutting copper alloy. At present, a copper alloy to which free-cutting property is imparted by adding 1.0 to 4.1% by weight of lead (Pb) to a brass alloy is widely used throughout the overall industry and living life.

However, since Restriction of Hazardous Substances (RoHS) was established by law in Europe in 2003, environmental regulations have been tightened up, regulations of elements hazardous to human health have been implemented, and research associated with a novel alloy that serves as a substitute for a free-cutting copper alloy that exhibits improved machinability based on addition of lead (Pb) has been made. In order to obtain machinability comparable to lead, brass alloys to which bismuth (Bi), selenium (Se), or telenium (Te) is added were developed. Although whether or not bismuth (Bi) is harmful to human health is not clear, bismuth (Bi), as a heavy metal such as lead (Pb), may be restricted in futures. Also, selenium (Se) and telenium (Te) are very expensive and are thus considerably unsuitable for general industrial applications. Also, since lead (Pb) and bismuth (Bi) entail high costs due to difficulty of recovery through general smelting and refining, need high energy when recovered by a physical method, and cause defects such as cracking during hot processing, used in a small amount in combination with a general copper alloy (see, reference document 1), thorough management of scrap is required for recycling of lead and bismuth.

In an attempt to resolve detriments of human and solve the problems associated with recycling of lead (Pb) and bismuth (Bi), alloys in which calcium (Ca) is added to brass have been developed (see Reference document 2). However, alloys exhibited insufficient hot processability, low dezincification resistance and thus insufficient corrosion resistance.

REFERENCE DOCUMENTS

1. Journal of the Japan Copper and Brass Research Association (ISSN: 0370-985X), VOL. 38, PAGE. 170-177 (1999)
2. Korean Patent Laid-open No. 10-2008-0071276

DISCLOSURE OF INVENTION

Technical Problem

An object of the present invention devised to solve the problems lies in a leadless free-cutting copper alloy wherein an intermetallic compound in which manganese is bonded to silicon is formed in a base material by incorporating a predetermined amount of manganese (Mg) and silicon (Si) into copper (Cu) without incorporating heavy metals, such as lead (Pb) and bismuth (Bi), harmful to human health, and machinability, cold workability and dezincification resistance are thus improved, and a method for producing the same.

Solution to Problem

The object of the present invention can be achieved by providing a leadless free-cutting copper alloy comprising: 56 to 77% by weight of copper (Cu); 0.1 to 3.0% by weight of manganese (Mn); 1.5 to 3.5% by weight of silicon (Si); and the balance of zinc (Zn) and other inevitable impurities (hereinafter, referred to as a "first invention").

Also, the leadless free-cutting copper alloy according to the present invention is characterized in that 0.1 to 1.5% by weight of calcium (Ca) is added to the alloy of the first invention in order to improve low-speed machinability (hereinafter referred to as a "second invention").

Also, the leadless free-cutting copper alloy according to the present invention is characterized in that at least one of 0.01 to 1.0% by weight of aluminum (Al), 0.01 to 1.0% by weight of tin (Sn), and 0.001 to 0.5% by weight of selenium (Se) is added to the first invention and the second invention, respectively, in order to refine alloy structure of the alloy and disperse the intermetallic compound and thereby further improve machinability (hereinafter, referred to as a "third invention").

Also, the leadless free-cutting copper alloy according to the present invention is characterized in that at least one of 0.01 to 1.0% by weight of iron (Fe), 0.001 to 1.0% by weight of zirconium (Zr), 0.001 to 0.1% by weight of boron (B), and 0.01 to 0.3% by weight of phosphorous (P) is added to the first invention, the second invention and the third invention, respectively, in order to refine the structure of the alloy and disperse the intermetallic compound (hereinafter, referred to as a "fourth invention"). Meanwhile, in the second invention of the leadless free-cutting copper alloy according to the present invention, phosphorous, unlike other elements, is preferably not added, since phosphorous reacts with calcium to produce calcium phosphate, thus lowering the content of calcium in the base material.

Also, provided is a method for producing the leadless free-cutting copper alloy according to the present invention, in particular, a method for obtaining a hot-processing material having a fine structure in order to improve machinability of the alloys of the first to fourth inventions, wherein hot rolling and hot extrusion processes are performed at a temperature of 570 to 660° C. in accordance with a conventional free-cutting brass production method (hereinafter, referred to as a "fifth invention").

Advantageous Effects of Invention

The leadless free-cutting copper alloy according to the present invention contains an alloy element harmless to human health other than copper (Cu) and zinc (Zn), thus exhibiting superior eco-friendliness, machinability, cold workability and dezincification resistance.

According to the leadless free-cutting copper alloy according to the present invention, unlike conventional inventions containing lead (Pb) or bismuth (Bi), an element harmless to human health such as manganese (Mn), silicon (Si), or calcium (Ca) is added to an alloy to impart machinability to the alloy. Accordingly, the leadless free-cutting copper alloy can be safely used as a material for faucets and exhibits superior cold workability and dezincification resistance due to addition of manganese. The manganese used in the present invention enhances a basic hardness of a base structure, is bonded to silicon to produce a Mn—Si compound and thus serves as a chip breaker that finely severs cutting chips. Also, manganese increases cold processability of the copper alloy according to the present invention and improves dezincification resistance, thus being effective in preventing elution of zinc.

Also, when calcium (Ca) is further added, calcium is bonded to copper to produce a Cu—Ca compound, machinability is further improved, in particular, low-speed machinability of Cu—Zn—Mn—Si alloy is improved, and chips are thus finely severed even during low-speed cutting.

Also, when aluminum (Al), tin (Sn), or selenium (Se) alone or in combination thereof is added, machinability is improved. Aluminum and tin facilitate formation of beta (β)-phase, improve hot processability, increase hardness, and disperse compounds produced in the structure, improve machinability, and enhance dezincification resistance.

Selenium (Se) is not dissolved in a brass matrix and serves as a chip breaker, and thus exhibits similar cutting properties to lead (Pb)-containing free-cutting brass.

Also, when iron (Fe), phosphorous (P), zirconium (Zr), or boron (B) is added alone or in combination, the structure of alloy is fine, an intermetallic compound is dispersed and machinability can thus be further improved.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 illustrates a graph showing a component range of a leadless free-cutting copper alloy according to the present invention.

FIG. 2 illustrates a graph showing a maximum cold processability according to the content of manganese.

FIG. 3 illustrates an image of cutting chips sorted based on fineness.

FIG. 4 illustrates an image comparing the shape of chips during low-speed cutting depending on whether or not calcium is contained.

MODE FOR THE INVENTION

The leadless free-cutting copper alloy according to the present invention comprises: 56 to 77% by weight of copper (Cu); 0.1 to 3.0% by weight of manganese (Mn); 1.5 to 3.5% by weight of silicon (Si); and the balance of zinc (Zn) and other inevitable impurities.

When the content of copper (Cu) is lower than 56% by weight, beta-phase is excessively produced and hot processing is advantageous, but cold processability is deteriorated, brittleness is increased, and dezincification corrosion actively occurs, and when the content is higher than 77% by weight, raw material costs increase, formation of beta-phase and gamma-phase is insufficient, and machinability and hot processability cannot be sufficiently secured.

When the content of manganese (Mn) is lower than 0.1% by weight, increase of hardness is insufficient, formation of Mn—Si intermetallic compound is difficult, machinability is little improved, and there is almost no prevention effect of dezincification corrosion. The cold workability caused by addition of manganese is improved, since crystalline-based Cu—Zn—Si compound is dispersed by formation of Mn—Si intermetallic compound. When the content of manganese is lower than 0.1% by weight, there it almost no effect of improvement in cold workability. Also, when the content of manganese is higher than 3.0% by weight, machinability is decreased, oxides are increased during casting, casting is inhibited and formation of normal ingots is thus difficult.

When the content of silicon (Si) is lower than 1.5% by weight, the cutting properties of the Mn—Si intermetallic compound are insufficient, and when the content is higher than 3.5% by weight, a Mn—Si intermetallic compound is grown and present, dispersion by hot processing is relatively difficult and improvement of machinability reaches a critical level.

When the content of zinc (Zn) is lower than 16.5% by weight, the content of copper (Cu), as a raw material, increases, production costs increase, discoloration and corrosion resistance are decreased due to surface oxidation, and when the content of zinc is higher than 42.4% by weight, the hardness and strength of material are excessively increased, brittleness is induced during cold processing and industrial application is difficult.

Also, the leadless free-cutting copper alloy according to the present invention further comprises 0.1 to 1.5% by weight of calcium (Ca) to improve low-speed machinability, in addition to the alloy of the first invention.

When the content of calcium (Ca) is lower than 0.1% by weight, formation of Cu—Ca compound having machinability is insufficient and improvement of machinability is insufficient, and when the content is higher than 1.5% by weight, casting property is deteriorated due to oxides increased during dissolution, it is difficult to obtain a normal ingot, and cracks are generated during hot processing due to production of low-melting point compound such as $Ca_2Cu$.

Meanwhile, the leadless free-cutting copper alloy according to the present invention is characterized in that at least one of 0.01 to 1.0% by weight of aluminum (Al), 0.01 to 1.0% by weight of tin (Sn), and 0.001 to 0.5% by weight of selenium (Se) to improve machinability is added to the first invention and the second invention, respectively.

When the content of aluminum (Al) is lower than 0.01% by weight, improvement of machinability is insufficient due to addition of aluminum, and when the content is higher than 1.0% by weight, the hardness of the produced copper alloy is excessively increased, brittleness is increased and cracks may thus be induced during cold processing.

When the content of tin (Sn) is lower than 0.01% by weight, improvement of machinability is insufficient due to the addition of tin, and when the content is higher than 1.0% by weight, the cost of raw materials is increased, dispersion of the compound produced in the structure is not effective, relative to the amount of added compound and improvement of machinability is thus limited.

When the content of selenium (Se) is lower than 0.001% by weight, there is no effect of cutting breaker and improvement of machinability is insufficient, and when the content is higher than 0.5% by weight, the cost of raw materials increases, and improvement of machinability, relative to the addition amount is thus limited.

Also, the leadless free-cutting copper alloy according to the present invention is characterized in that at least one of 0.01 to 1.0% by weight of aluminum (Al), 0.01 to 1.0% by weight of tin (Sn), and 0.001 to 0.5% by weight of selenium (Se) is added to the first invention, the second invention and the third invention, respectively, in order to make the alloy structure fine, disperse the intermetallic compound and thereby further improve machinability.

When the content of iron (Fe) is lower than 0.01% by weight, structure fineness effect is low, and when the content is higher than 1.0% by weight, the fineness of the structure is limited and corrosion properties may be deteriorated.

When the content of zirconium (Zr) is lower than 0.001% by weight, the effect of structure fineness is low, and when the content is higher than 1.0% by weight, the cost of raw materials is excessively high, oxides are excessively produced, casting property is deteriorated and production of normal ingot is difficult.

When the content of boron (B) is lower than 0.001% by weight, the effect of structure fineness is low and, when the content is higher than 0.1% by weight, structure fineness is limited.

In the present invention, phosphorous (P) contributes to the fineness of structure, serves as a deoxidizer and thus improves flowability of molten metal. However, when the content is lower than 0.01% by weight, there is almost no effect of structure fineness, and when the content is higher than 0.3% by weight, structure fineness is limited and hot processability is deteriorated. Also, in the copper alloy according to the second invention, preferably, phosphorous (P) is not used since it reacts with calcium (Ca) to form calcium phosphate, which decreases the content of calcium in the base material.

Meanwhile, a method for producing the leadless free-cutting copper alloy according to the present invention, in particular, a method for obtaining a hot-processing material having a fine structure in order to improve machinability of the alloy of the first invention to the fourth invention, respectively, is characterized in that hot rolling and hot extrusion processes are performed at a temperature of 570 to 660° C. More specifically, the method comprises obtaining an ingot from the alloy according to the first invention, the second invention, the third invention or the fourth invention, obtaining a hot-processed material using the obtained ingot, obtaining a cold-processed material using the obtained hot-processed material and optionally hot-forging.

The obtaining the ingot is carried out by melting the alloy component at a temperature of 1,000° C. or less to produce a molten metal, allowing to stand for 20 minutes and casting. Since the component of copper alloy according to the present invention contains a great amount of oxides, it is important to secure a normal ingot using low-speed casting and other casting methods.

The obtaining the hot-processed material is carried out by cutting the ingot into a predetermined length, primarily heating the ingot in a gas furnace at 400 to 600° C. for 1 to 10 hours to homogenize the ingot structure, secondarily heating the ingot in an electric induction furnace at 570 to 660° C. for 5 minutes or shorter, and immediately performing hot extrusion. The hot extrusion speed is controlled to 6 to 20 mpm according to secondary heating temperature and the pressure generated during extrusion. The structure of hot-processed material becomes finer, as hot-processing temperature decreases.

When the temperature of hot extrusion is lower than 570° C., the pressure generated during extrusion is excessively high, extrusion speed cannot be increased and production efficiency is thus deteriorated, and when the temperature exceeds 660° C., it is difficult to obtain fine particles and, disadvantageously, direct extruder-type equipment further induces piping defects.

The obtaining the cold-processed material from the obtained hot-processed material is carried out by cold processing using a drawer to have the desired diameter and tolerance using the obtained hot-processed material and securing straightness using a straightening machine.

The cold-processed material thus obtained is optionally subjected to hot forging. At this time, the heating of the material during hot forging is preferably carried out at a temperature of 600 to 800° C. within 30 minutes. Immediately after heating is completed, hot forging is performed. When heating temperature during hot forging is lower than 600° C., forge property is deteriorated and the desired shape cannot be obtained when the shape is complicated, and when the heating temperature exceeds 800° C., machinability of the forged produced may be inhibited during post processing. The post process may include other processes such as processing and plating that is suitable for the requirement properties of the products.

Hereinafter, the present invention will be described with reference to Examples along with tables and drawings in detail.

Table 1 illustrates Examples of the present invention. The specimens of examples are produced by casting and hot rolling. The characteristics of specimens of respective Examples are expressed based on evaluation of machinability, dezincification depth and cold workability. A detailed method is described with reference to Example 1.

In order to produce a specimen of Example 1, 680 g of copper (Cu), 304 g of zinc (Zn), 15 g of silicon (Si), and 1 g of manganese (Mn) were mixed, and the mixture was added to a graphite crucible, and melted using a high frequency induction furnace. The obtained molten metal was cast into a graphite mold with a thickness of 20 mm, a width 50 mm and a length 150 mm, to obtain an ingot having a length of about 125 mm. The ingot was pre-heated at 650° C. in a box furnace for one hour, and hot-rolled at a draft percentage of about 50% using a two high mill.

Regarding specimen hardness, the specimen hardness was measured by applying a load of 10 kg to the specimen using a Vickers hardness tester.

Regarding alloy machinability, behaviors of cutting chips observed during dipping were compared using a machinability tester, the cutting chips were classified based on fineness, and the hot rolled specimens were expressed as 10 kinds of cutting numbers (Chip No.)

As the cutting chip has a smaller cutting number, it becomes finer. During cutting, the cutting tip has a size of Φ9.5 mm, a rotation speed of 750 RPM, a movement speed of 70 mm/min, a movement distance of 7 mm, and a gravity direction as a movement direction.

The alloy dezincification depth is represented as a dezincification corrosion depth measured in accordance with KSD ISO 6509 (corrosion test of metals and alloys—dezincification corrosion of brass).

The cold workability of alloy was obtained by heating ingot specimens of Examples 1-13 to 1-20 at 650° C. for 90 minutes, hot rolling at a draft percentage of about 50%, water-cooling, and measuring a cold-draft percentage until cracking occurs during cold-rolling. As cold-draft percentage increases, cold workability is improved.

FIG. 1 is a graph showing a component region of copper alloy according to the present invention. The alloy of present invention contains manganese (Mn), calcium (Ca) and other additional alloy elements, in addition to a conventional copper alloy, and is thus different from a component region of the conventional copper alloy.

As can be seen from Examples 1-13 to 1-20 of Table 1 above, as the content of manganese (Mn) increases from 0.1% by weight to 3.5% by weight, cold draft percentage (%) increases. The results thus obtained are shown in the graph of FIG. 2.

As can be seen from Table 1, as the contents of silicon (Si) and manganese (Mn) in the copper alloy increase, hardness (Hv) increases, and the chip number of cutting chips decreases. The cutting chips of respective Examples are expressed as Chip No. that is classified based on fineness shown in Tables 1 to 4, and the image of cutting chips corresponding to Chip No. is shown in FIG. 3. As the Chip. No. of FIG. 3 becomes smaller, the cutting chips are finer. The segmentation was almost not observed in chips having Chip No. 10 of FIG. 3 containing copper (Cu) and zinc (Zn) alone. Chip No. 9 is a case in which chips are rolled in a longitudinal direction, but segmentation is observed. Chip No. 8 is a case in which chips are rolled in a short section, but segmentation periodically occurs. Chip No. 7 is a case in which rolling of chips is reduced in the form of a funnel and the cycle of segmentation is shortened. Chip No. 6 is a case in which the shape of chips is changed from funnel to fan and the size of chips is thus decreased. Chip No. 5 is a case in which segmented fan-shaped chips are self-rolled. Chip No. 4 is a case in which the fan-shaped chips are more finely segmented in an early stage. Chip No. 3 is a case in which fan-shaped chips are generated along with finely segmented chips. Chip No. 2 is a case in which fan-shaped chips completely disappear and only finer segmented chips are generated. Chip No. 1 is a case in which cutting chips have a linear shape and are considerably fine.

As can be seen from dezincification depths of Examples 1-1 to 1-12 of Table 1 above, as contents of silicon (Si) and manganese (Mn) increase, dezincification depth decreases. This means that silicon and manganese improve dezincification resistance.

TABLE 1

| | | Alloy components | | | | Hardness | Cold draft percentage | Dezincification Depth | Chip |
|---|---|---|---|---|---|---|---|---|---|
| | | Cu | Zn | Si | Mn | (Hv) | (%) | (μm) | No. |
| Examples of the first invention | 1-1 | 68 | Bal. | 1.5 | 0.1 | 102 | | 106 | 9 |
| | 1-2 | 68 | Bal. | 2.5 | 0.1 | 128 | | 104 | 7 |
| | 1-3 | 68 | Bal. | 3.5 | 0.1 | 149 | | 71 | 3 |
| | 1-4 | 68 | Bal. | 1.5 | 1.0 | 155 | | 62 | 7 |
| | 1-5 | 68 | Bal. | 2.5 | 1.0 | 160 | | 60 | 5 |
| | 1-6 | 68 | Bal. | 3.5 | 1.0 | 182 | | 38 | 2 |
| | 1-7 | 68 | Bal. | 1.5 | 2.0 | 137 | | 44 | 6 |
| | 1-8 | 68 | Bal. | 2.5 | 2.0 | 178 | | 28 | 4 |
| | 1-9 | 68 | Bal. | 3.5 | 2.0 | 194 | | 24 | 3 |
| | 1-10 | 68 | Bal. | 1.5 | 3.0 | 157 | | 21 | 4 |
| | 1-11 | 68 | Bal. | 2.5 | 3.0 | 188 | | 20 | 2 |
| | 1-12 | 68 | Bal. | 3.5 | 3.0 | 196 | | 18 | 2 |
| | 1-13 | 68 | Bal. | 2.5 | 0.1 | 128 | 14 | 104 | 7 |
| | 1-14 | 68 | Bal. | 2.5 | 0.5 | 149 | 21 | 77 | 6 |
| | 1-15 | 68 | Bal. | 2.5 | 1.0 | 160 | 28 | 60 | 5 |
| | 1-16 | 68 | Bal. | 2.5 | 1.5 | 171 | 30 | 49 | 4 |
| | 1-17 | 68 | Bal. | 2.5 | 2.0 | 178 | 33 | 28 | 4 |
| | 1-18 | 68 | Bal. | 2.5 | 2.5 | 182 | 36 | 27 | 3 |
| | 1-19 | 68 | Bal. | 2.5 | 3.0 | 188 | 37 | 20 | 2 |
| | 1-20 | 68 | Bal. | 2.5 | 3.5 | 201 | 38 | 18 | 3 |

Bal.: Balance

TABLE 2

| | | Alloy components | | | | | Hardness | Dezincification depth | Chip |
|---|---|---|---|---|---|---|---|---|---|
| | | Cu | Zn | Si | Mn | Ca | (Hv) | (μm) | No. |
| Examples of the second invention | 2-1 | 68 | Bal. | 2.5 | 1.0 | 0.1 | 161 | 68 | 5 |
| | 2-2 | 68 | Bal. | 2.5 | 1.0 | 0.5 | 165 | 72 | 2 |
| | 2-3 | 68 | Bal. | 2.5 | 1.0 | 1.0 | 168 | 75 | 1 |
| | 2-4 | 68 | Bal. | 2.5 | 1.0 | 1.5 | 171 | 90 | 1 |
| | 2-5 | 68 | Bal. | 2.5 | 0.5 | 0.1 | 149 | 78 | 4 |
| | 2-6 | 68 | Bal. | 2.5 | 0.5 | 0.5 | 152 | 83 | 2 |
| | 2-7 | 68 | Bal. | 2.5 | 0.5 | 1.0 | 159 | 89 | 1 |
| | 2-8 | 68 | Bal. | 2.5 | 0.5 | 1.5 | 168 | 101 | 1 |
| | 2-9 | 68 | Bal. | 2.5 | 0.1 | 0.1 | 112 | 110 | 6 |
| | 2-10 | 68 | Bal. | 2.5 | 0.1 | 0.5 | 129 | 116 | 3 |
| | 2-11 | 68 | Bal. | 2.5 | 0.1 | 1.0 | 138 | 123 | 2 |
| | 2-12 | 68 | Bal. | 2.5 | 0.1 | 1.5 | 144 | 124 | 1 |

Also, as can be seen from Table 2, as calcium (Ca) is added, hardness increases and Chip No. decreases. The addition of calcium improves high-speed cutting properties of copper alloy according to the first invention and enhances low low-speed cutting properties. In Table 2, as a result of comparison of low-speed cutting chip behaviors of copper alloys containing the components shown in Examples 1-5 to 2-3, the cutting chips of copper alloys further containing calcium are finely segmented. That is, machinability is further improved. The compared cutting chip behaviors are shown in FIG. 4. Here, high-speed cutting refers to a cutting process in which a drill tip having a diameter of Φ9.5 mm that rotates at a speed of 750 RPM is cut in a gravity direction at a speed of 70 mm/min. Low-speed cutting refers to a cutting process performed under the same conditions as the high-speed cutting, except that the movement speed of the drill tip in a gravity direction is 8 mm/min.

Also, as can be seen from dezincification depth values of Examples 2-1 to 2-12 of Table 2, as the content of calcium (Ca) increases, dezincification depth increases. Accordingly, this means that calcium decreases dezincification resistance.

TABLE 3

| | | Alloy components | | | | | | | | hardness | dezincification depth | Chip |
|---|---|---|---|---|---|---|---|---|---|---|---|---|
| | | Cu | Zn | Si | Mn | Ca | Al | Sn | Se | (Hv) | (μm) | No. |
| Examples of the third invention | 3-1 | 68 | Bal. | 2.5 | 1.0 | | 0.01 | | | 162 | | 5 |
| | 3-2 | 68 | Bal. | 2.5 | 1.0 | | 0.5 | | | 171 | 48 | 4 |
| | 3-3 | 68 | Bal. | 2.5 | 1.0 | | 1.0 | | | 188 | | 3 |
| | 3-4 | 68 | Bal. | 2.5 | 1.0 | 0.5 | 0.5 | | | 177 | | 1 |
| | 3-5 | 68 | Bal. | 2.5 | 1.0 | | | 0.01 | | 157 | | 3 |
| | 3-6 | 68 | Bal. | 2.5 | 1.0 | | | 0.5 | | 162 | 51 | 2 |
| | 3-7 | 68 | Bal. | 2.5 | 1.0 | | | 1.0 | | 171 | | 2 |
| | 3-8 | 68 | Bal. | 2.5 | 1.0 | 0.5 | | 0.5 | | 166 | | 1 |
| | 3-9 | 68 | Bal. | 2.5 | 1.0 | | | | 0.001 | 160 | | 2 |
| | 3-10 | 68 | Bal. | 2.5 | 1.0 | | | | 0.1 | 161 | | 1 |
| | 3-11 | 68 | Bal. | 2.5 | 1.0 | | | | 0.5 | 163 | 68 | 1 |
| | 3-12 | 68 | Bal. | 2.5 | 1.0 | 0.5 | | | 0.1 | 162 | | 1 |

TABLE 4

| | | Alloy components | | | | | | | | | Hardness | Dezincification Depth | Chip |
|---|---|---|---|---|---|---|---|---|---|---|---|---|---|
| | | Cu | Zn | Si | Mn | Ca | Fe | P | Zr | B | (Hv) | (μm) | No. |
| Examples of the fourth invention | 4-1 | 68 | Bal. | 2.5 | 1.0 | | 0.01 | | | | 163 | | 4 |
| | 4-2 | 68 | Bal. | 2.5 | 1.0 | | 0.5 | | | | 167 | 64 | 3 |
| | 4-3 | 68 | Bal. | 2.5 | 1.0 | | 1.0 | | | | 176 | | 3 |
| | 4-4 | 68 | Bal. | 2.5 | 1.0 | 0.5 | 0.5 | | | | 169 | | 1 |
| | 4-5 | 68 | Bal. | 2.5 | 1.0 | | | 0.01 | | | 161 | | 4 |
| | 4-6 | 68 | Bal. | 2.5 | 1.0 | | | 0.1 | | | 162 | 61 | 3 |
| | 4-7 | 68 | Bal. | 2.5 | 1.0 | | | 0.3 | | | 166 | | 2 |
| | 4-8 | 68 | Bal. | 2.5 | 1.0 | | | | 0.001 | | 159 | | 3 |
| | 4-9 | 68 | Bal. | 2.5 | 1.0 | | | | 0.5 | | 168 | 58 | 2 |
| | 4-10 | 68 | Bal. | 2.5 | 1.0 | | | | 1.0 | | 186 | | 2 |
| | 4-11 | 68 | Bal. | 2.5 | 1.0 | 0.5 | | | 0.5 | | 171 | | 1 |
| | 4-12 | 68 | Bal. | 2.5 | 1.0 | | | | | 0.001 | 162 | | 5 |

TABLE 4-continued

| | Alloy components | | | | | | | | | Hardness | Dezincification Depth | Chip |
|---|---|---|---|---|---|---|---|---|---|---|---|---|
| | Cu | Zn | Si | Mn | Ca | Fe | P | Zr | B | (Hv) | (μm) | No. |
| 4-13 | 68 | Bal. | 2.5 | 1.0 | | | | | 0.05 | 165 | 61 | 3 |
| 4-14 | 68 | Bal. | 2.5 | 1.0 | | | | | 0.1 | 171 | | 2 |
| 4-15 | 68 | Bal. | 2.5 | 1.0 | 0.5 | | | | 0.05 | 170 | | 1 |

As can be seen from Tables 3 and 4, the copper alloy according to the first invention and the copper alloy according to the second invention further comprise any one of aluminum (Al), tin (Sn) and selenium (Se), or any one of iron (Fe), phosphorous (P), zirconium (Zr) and boron (B), thus improving hardness, decreasing Chip No. of cutting chips and thus making the cutting chips finer.

Also, as can be seen from dezincification depths of Tables 3 and 4, as aluminum (Al) and tin (Sn) are added, dezincification depth is decreased, addition of selenium (Se) and iron (Fe) slightly increases dezincification depth, and phosphorous (P), zirconium (Zr), and boron (B) have almost no influence on dezincification depth.

TABLE 5

| | | Alloy components | | | | Hardness of hot extrusion | Hot-pressing temperature | Particle size | Chip |
|---|---|---|---|---|---|---|---|---|---|
| | | Cu | Zn | Si | Mn | (Hv) | (° C.) | (μm) | No. |
| Examples of the fifth invention | 5-1 | 68 | Bal. | 2.5 | 1.0 | 168 | 570 | 10 | 3 |
| | 5-2 | 68 | Bal. | 2.5 | 1.0 | 160 | 600 | 15 | 4 |
| | 5-3 | 68 | Bal. | 2.5 | 1.0 | 145 | 630 | 35 | 6 |
| | 5-4 | 68 | Bal. | 2.5 | 1.0 | 130 | 660 | 60 | 7 |

As can be seen from Examples 5-1 to 5-4 of Table 5 above, as hot extrusion temperature is increased from 570 to 660° C., hardness of hot extrude material is slightly decreased, particles of structure increase, and Chip No. of cutting chips is also increased. Based on these behaviors, a range of the hot-extrusion temperature required for maintaining machinability of the invented alloy is set to 570 to 660° C.

As apparent from the fore-going, the leadless free-cutting copper alloy according to the present invention exhibits superior machinability and dezincification resistance and excellent cold workability, thus is useful as a leadless free-cutting copper alloy that is harmless to human health and is suitable for various industry applications.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A leadless free-cutting copper alloy comprising:
56 to 77% by weight of copper (Cu);
0.1 to 3.0% by weight of manganese (Mn);
1.5 to 3.5% by weight of silicon (Si);
0.1 to 1.5% by weight of calcium (Ca); and
the balance of zinc (Zn) and other inevitable impurities.

2. The leadless free-cutting copper alloy according to claim 1, further comprising:
one or more selected from the group consisting of 0.01 to 1.0% by weight of aluminum (Al), 0.01 to 1.0% by weight of tin (Sn), and 0.001 to 0.5% by weight of selenium (Se).

3. The leadless free-cutting copper alloy according to claim 1, further comprising:
one or more selected from the group consisting of 0.01 to 1.0% by weight of iron (Fe), 0.001 to 1.0% by weight of zirconium (Zr), and 0.001 to 0.1% by weight of boron (B).

4. A method for producing the leadless free-cutting copper alloy according to claim 1, comprising:
hot-rolling and hot-extruding the alloy by heating at a temperature of 570 to 660° C.

5. A method for producing the leadless free-cutting copper alloy according to claim 1, comprising:
hot-rolling and hot-extruding the alloy by heating at a temperature of 570 to 660° C.

6. A method for producing the leadless free-cutting copper alloy according to claim 2, comprising:
hot-rolling and hot-extruding the alloy by heating at a temperature of 570 to 660° C.

7. The leadless free-cutting copper alloy according to claim 1, wherein the alloy is devoid of a heavy metal.

8. The leadless free-cutting copper alloy according to claim 1, wherein the alloy is devoid of bismuth.

9. The leadless free-cutting copper alloy according to claim 1, wherein the alloy has low speed machinability.

10. The leadless free-cutting copper alloy according to claim 1, wherein the alloy is devoid of phosphorous.

11. The leadless free-cutting copper alloy according to claim 1, consisting essentially of:
56 to 77% by weight of copper (Cu);
0.1 to 3.0% by weight of manganese (Mn);
1.5 to 3.5% by weight of silicon (Si);
0.1 to 1.5% by weight of calcium (Ca); and
the balance of zinc (Zn) and other inevitable impurities.

* * * * *